United States Patent [19]

D'Onofrio

[11] Patent Number: 4,812,945

[45] Date of Patent: Mar. 14, 1989

[54] METHOD AND APPARATUS FOR PROVIDING AUTORANGING FOR AN AC/DC POWER MANAGEMENT CIRCUIT FOR DC SOLENOID ACTUATORS

[75] Inventor: Anthony D'Onofrio, West Hartford, Conn.

[73] Assignee: Honeywell Inc., Minneapolis, Minn.

[21] Appl. No.: 45,644

[22] Filed: May 4, 1987

[51] Int. Cl.[4] ..... H01H 47/32; H01H 47/12; H01H 9/00; H01H 51/30

[52] U.S. Cl. ..... 361/154; 361/187; 361/194; 361/203

[58] Field of Search ..... 361/154, 187, 194, 203

[56] References Cited

U.S. PATENT DOCUMENTS 4,173,030 10/1979 Rabe ..... 361/154
4,630,165 12/1986 D'Onofrio ..... 361/154
4,631,629 12/1986 Mallick, Jr. ..... 361/154

*Primary Examiner*—L. T. Hix
*Assistant Examiner*—David Porterfield
*Attorney, Agent, or Firm*—Mitchell J. Halista; Albin Medved

[57] ABSTRACT

A method for providing a power management for a DC solenoid actuator includes the steps of initially supplying a first number of DC current pulses to the actuator and after a first time interval reducing the number of pulses applied to the solenoid in direct proportion to an output voltage of a source of the DC power. The method further includes the step of changing the duration of the first time period in direct proportion to the output voltage of the source of the DC power. An apparatus utilizing this method includes a timer for selectively providing a sequence of current pulses, circuit means for applying the pulses to a DC operated electromagnetic solenoid, power supply means responsive to an input voltage for supplying DC power to the timer means and compensating means for controlling the timer means to reduce the number of pulses applied to the solenoid after an initial maximum number of pulse applications during a first time period by changing the off time between the reduced number of pulses in direct proportion to the magnitude of the input voltage to maintain a predetermined average current in the solenoid during the time of the reduced number of pulses and being responsive to the input voltage for changing the duration of the first time period in direct proportion to the magnitude of the input voltage to maintain a predetermined average current in the solenoid during the first time period.

17 Claims, 3 Drawing Sheets

FIG. 3
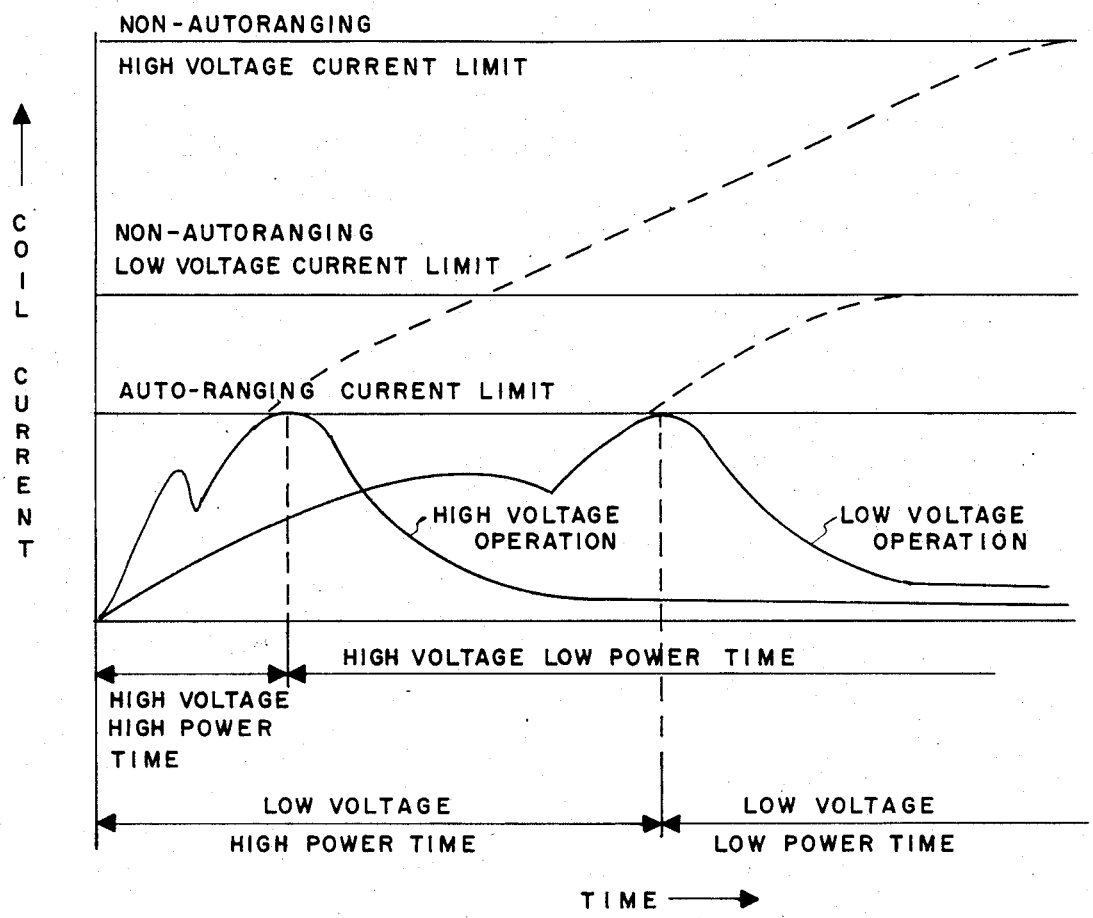
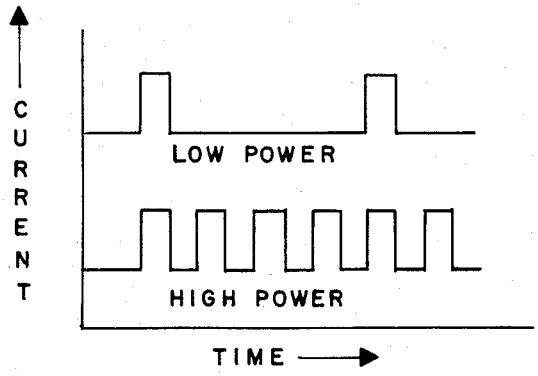
FIG. 4
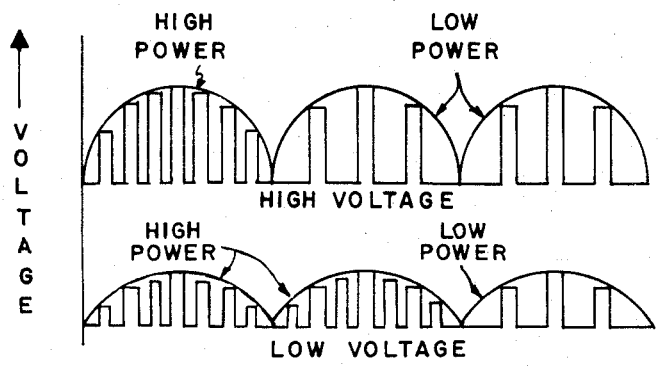
FIG. 5

METHOD AND APPARATUS FOR PROVIDING AUTORANGING FOR AN AC/DC POWER MANAGEMENT CIRCUIT FOR DC SOLENOID ACTUATORS

BACKGROUND OF THE INVENTION

1. Field of the Invention

The present invention relates to solenoid actuators. More specifically, the present invention is directed to an input power voltage adaptability for a power management circuit for direct current solenoid valves.

2. Description of the Prior Art

Direct current (DC) operated solenoid valves have been operated from various input voltages, e.g., 12 volts DC to 240 volts AC (alternating current). In order to adapt the solenoid valve to such input voltages, a different solenoid coil is used. This has led to a proliferation of coils required for the same valve body. Further, the ratings of the valves are different for DC and AC operation, e.g., DC operation usually had a lower pressure rating for the same size valve orifice. That situation was obviously uneconomical in terms of valve manufacturing, valve cost and inventory maintenance. Accordingly, it would be desirable to provide a solenoid valve operating circuit having a capability of accommodating a range of AC and DC input power voltage, identified herein as autoranging. Such an autoranging capability would enable a single coil to be used for a valve family which would operate over the aforesaid range of AC and DC input power voltages while automatically maintaining a power management operation for the solenoid coil. This would provide valve ratings which would be the same for AC and DC. Further, such a feature would effect a product cost reduction as a result of providing a larger volume base for manufacturing as well as reducing inventories for manufacturing and distribution while concurrently minimizing parts, machining operations and testing.

SUMMARY OF THE INVENTION

An object of the present invention is to provide a power management method and circuit having an adaptability for a range of AC/DC power supply voltage for solenoid actuators.

Another object of the present invention is to provide an improved DC power management method and circuit having an adaptability for a range of AC/DC power supply voltages for a DC solenoid valve actuator.

In accomplishing these and other objects, there has been provided, in accordance with the present invention, a method for providing power management for a DC solenoid actuator includes the steps of initially supplying a first number of DC current pulses to the actuator and after a first time interval reducing the number of pulses applied to the solenoid in direct proportion to an output voltage of a source of the DC power. The method further includes the step of changing the duration of the first time period in direct proportion to the output voltage of the source of the DC power. An apparatus utilizing this method includes a timer for selectively providing a sequence of current pulses, circuit means for applying the pulses to a DC operated electromagnetic solenoid, power supply means responsive to an input voltage for supplying DC power to the timer means and compensating means for controlling the timer means to reduce the number of pulses applied to the solenoid after an initial maximum number of pulse applications during a first time period by being responsive to the input voltage and changing the off time between the reduced number of pulses in direct proportion to the output voltage of the source of DC power. An apparatus utilizing this method includes a timer for selectively providing a sequence of current pulses, circuit means for applying the pulses to a DC operated electromagnetic solenoid, power supply means responsive to an input voltage for supplyoing DC power to the timer means and compensating means for controlling the timer means to reduce the number of pulses applied to the solenoid after an initial maximum number of pulse applications during a first time period for changing the off time between the reduced number of pulses in direct proportion to the magnitude of the input voltage to maintain a predetermined average current in the solenoid during the time of the reduced number of pulses and being responsive to the input voltage for changing the duration of the first time period in the direct proportion to the magnitude of the input voltage to maintain a predetermined average current in the solenoid during the first time period.

BRIEF DESCRIPTION OF THE DRAWING

A better understanding of the present invention may be had when the following detailed description is read in connection with the accompanying drawings, in which:

FIG. 3 is a waveshape diagram illustrating autoranging and non-autoranging operation for high and low input voltages, FIG. 4 is a waveshape diagram illustrating high and low power coil current operation and FIG. 5 is a waveshape diagram illustrating high and low power operation with respect to high and low voltage AC inputs.

DESCRIPTION OF THE PREFERRED EMBODIMENT

Figure 1:
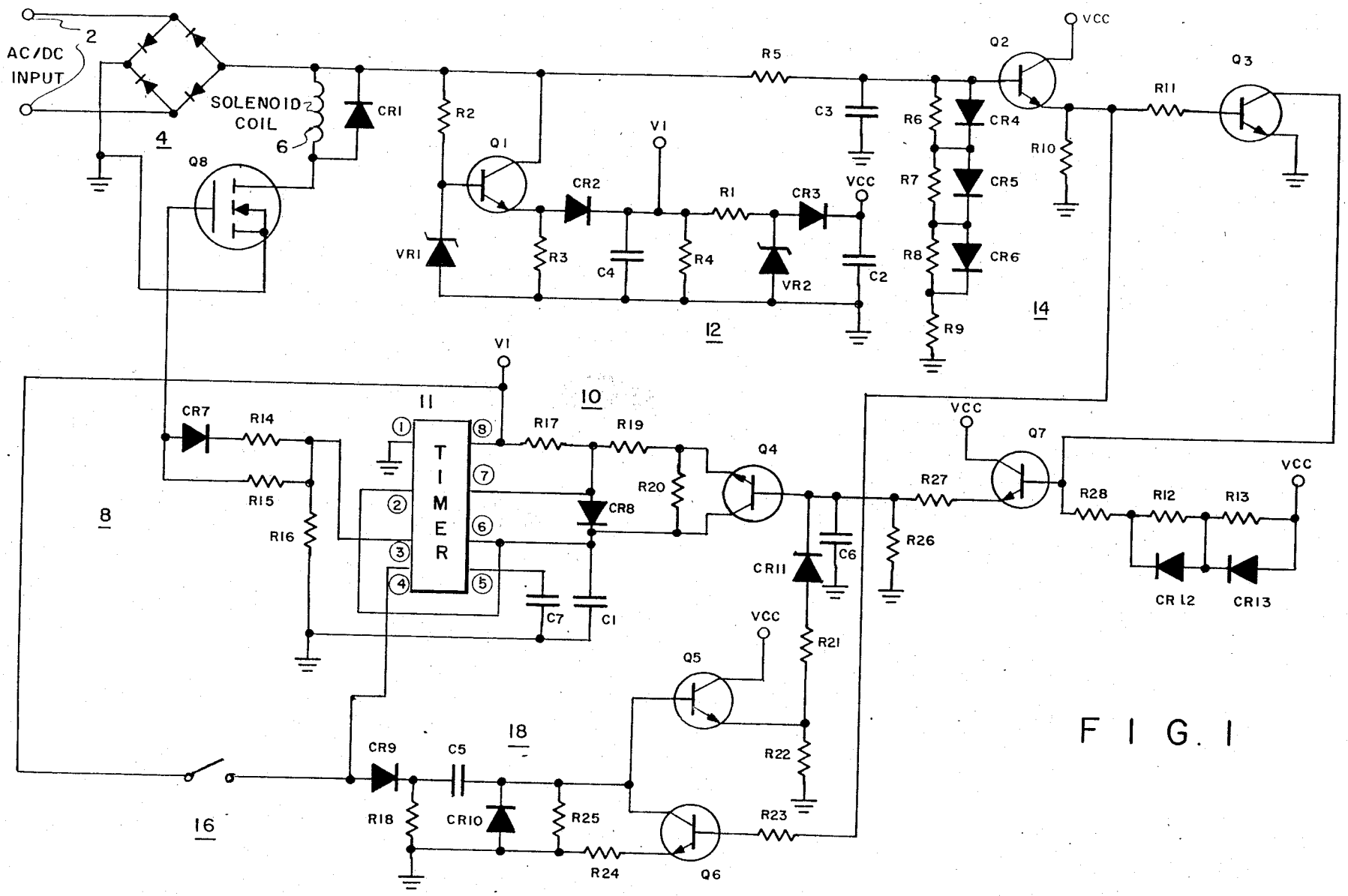
FIG. 1 is a schematic illustration of an autoranging AC/DC power management circuit in a DC valve embodiment of the present invention.

Referring to FIG. 1 in more detail, there is shown an autoranging AC/DC power management system including a pair of input terminals 2 for connecting the circuit to a source of alternating current (AC) or direct current (DC) power. The input terminals 2 are connected across a full-wave rectifier bridge 4 having one of its output terminals connected to a common ground connection and the other one to one side of a solenoid coil 6 used as a solenoid actuator. A first diode CR1 is connected across the solenoid coil 6 to bypass any backward current while the other end of the solenoid coil 6 is connected through an FET transistor Q8 to the ground connection. A gate electrode for the transistor Q8 is connected to a drive circuit 8 controlled by the output of a pulse supply circuit 10 including a timer 11. A voltage regulator circuit 12 is also supplied from the full-wave rectifier bridge 4 to provide regulated voltages to a voltage adjusting circuit 14 for providing suitable voltages for the pulse supply circuit 10. A switch 16 is selectively operated to connect a control voltage $V_1$ to the control input 4 of the timer and a delay or timing circuit 18.

The description of the aforesaid U.S. Pat. No. 4,630,165 is incorporated herein by reference in order to provide a description of a basic operation of the solenoid control circuit for DC solenoid coils such as those used in solenoid valves. That basic circuit does not provide the autoranging advantages found in the present invention wherein a wide range of power supply voltage is automatically accommodated to enable one coil to be used independently of the operating or input voltage. That basic DC control circuit is effective to provide a high pull-in current which is the average of the control pulses from the timer 11. Specifically, when the control input signal applied to the control input 6 of the timer 11 goes "high", the transistor Q4 and the timer 11 are turned "on". The timer 11 now runs as a free-running multivibrator producing a high frequency, e.g., 2 kHz, output which drives the FET transitor Q8 whereby the average current through the solenoid coil 6 is controlled by the pulses applied to the FET transistor Q8. The timer circuit 18 will determine when the transistor Q4 is turned "off" to switch the average solenoid coil current to the low power, or hold, mode. Thus, when the valve "off" time is increased, the average current in the coil 6 will decrease to the "hold" value. On the other hand, when the valve is turned "on", i.e., during the pull-in current value, the "off" time is very short.

After a suitable delay time of approximately two times the "pull-in" time, e.g., 4–100 milliseconds, the power to the coil 6 is switched to the low power to "hold-in" mode at which time the transistor Q4 is turned "off". The voltage drop across the resistor R20 is now effective to determine the holding current, i.e., the valve "off" time. The free-running frequency of the timer 11 is selected to be high enough to eliminate the switching of the valve from "on" to "off" with the output pulses from the timer 11. Thus, the average current and therefore the average power to the valve is controlled to eliminate overheating and/or burnout of the solenoid coil 6, e.g., pull-in power can be 14 watts while a comparable hold-in power would be 380 milliwatts. While the foregoing discussion has been presented in the context of a solenoid valve, the present invention is obviously applicable to other electromagnetic circuits which can operate between high and low power modes, e.g., electromagnetic relays.

Figure 2:
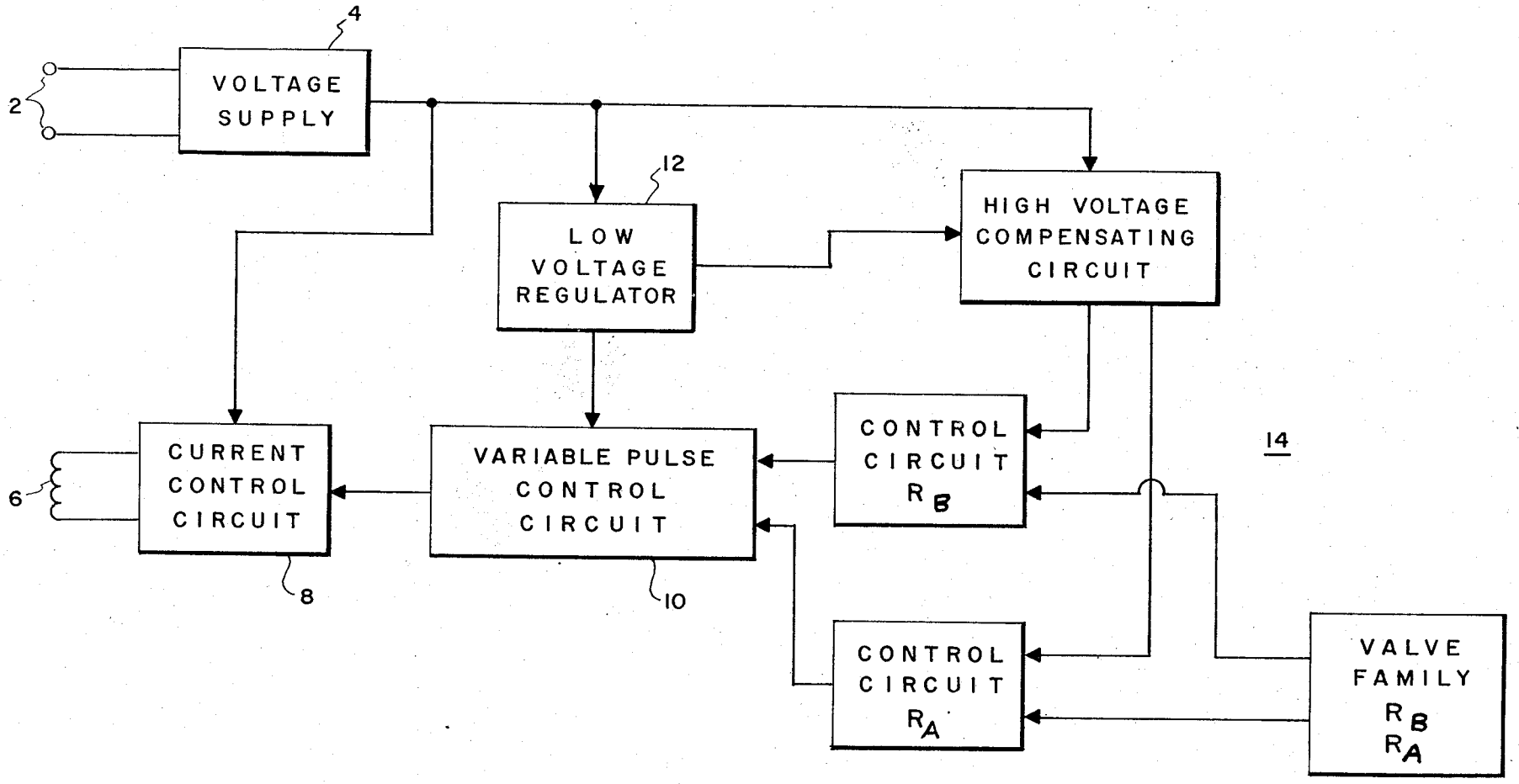
FIG. 2 is a block diagram representation of the circuit shown in FIG. 1.

The present invention is directed to a circuit for enabling the solenoid control circuit to operate on a range of input power voltages. The following discussion is directed to this novel aspect of the solenoid control circuit and is directed to the block diagram shown in FIG. 2 and the waveshape diagrams illustrated in FIGS. 3, 4 and 5. Referring to the block diagram shown in FIG. 2, a variable voltage input, e.g., from 10 volts to 240 volts AC or DC, is applied to the input terminals 2. This input voltage is full wave rectified by the voltage supply 4 as illustrated by the voltage envelope shown in FIG. 5. The rectified output of the voltage supply 4 is applied to the low voltage regulator 12 and the high voltage compensating circuit 14 to develop the voltages necessary for controlling the power levels for the coil 6, e.g., a regulated 8 volt DC is applied to the high voltage compensating circuit 14 and 10 volt DC is applied to the variable pulse control circuit 10. A modification of this arrangement wherein a single 8 volt DC is applied to both circuits can be used by providing electrical isolation, i.e., decoupling, between the compensating circuit 14 and the pulse control circuit 10. The rectified output of the voltage supply 4 is also applied to the valve current control circuit 8 and to the high voltage compensating circuit 14. The compensating circuit 14, in turn, provides the proper compensating voltages to the $R_A$ and $R_B$ control circuits. The initial values of $R_A$ and $R_B$ are determined by the valve type or family and solenoid operator requirements.

As the input voltage varies from one value to another within the voltage limits discussed above, the compensating circuit 14 changes the voltages supplied to the $R_A$ and $R_B$ control circuits in an opposite manner, i.e., one voltage is increased and the other is decreased in a linear manner along a common slope of a voltage versus time relationship. For example, as the input voltage increases, the average power supplied to the coil 6 must be maintained at a preset level. The voltage compensation for the $R_A$ control circuit by the high voltage compensation circuit 4 has to provide for an increase in the "off" time as illustrated in FIG. 4 and as described above. The values of $R_A$ and $R_B$ provide the means for controlling the pulse control circuit 10 for input voltage changes and coil operation requirements. For example, an increase in input voltage produces a decrease in the $R_A$ voltage which, in turn, increases the "off" time to reduce the coil power while the "on" time is kept constant (as shown in FIG. 4) by the pulse control circuit 10.

The voltage for the $R_B$ control circuit, on the other hand, is increased, as discussed above, which is effective to reduce the time that the pulse control circuit 10 is in the high power mode, as shown in FIG. 5. Thus, the higher the input voltage, the shorter the high power mode is maintained which is necessary to limit the power to the coil 6, as shown in FIG. 3. In summary, while the resistors $R_A$ and $R_B$ have selected values, the voltages applied thereto are automatically compensated as a function of the input voltage to provide the autoranging function. In other words, an input voltage increase results in a current decrease in the coil 6 to maintain a constant power dissipation in the coil independently of the input voltage and vice versa. Without the power control afforded by the autoranging circuit, the coil 6 could be damaged by excessive current. Conversely, with the autoranger circuit a 6 volt coil could be used with a 240 volt AC input voltage without coil damage. As shown in FIG. 3, a dip in the coil current curves occurs when the valve seats and the supplemental coil current after that point produces coil heating. By limiting the peak current and imposing a low power mode, this excess heating is eliminated to reduce power consumption without degrading valve performance.

Referring to FIG. 1 in more detail, the output voltage from the power input terminals 2 is applied to the full-wave rectifier bridge circuit 4 to produce a variable DC voltage input to the autoranging power management circuit for either AC or DC power input voltages. An example of a power voltage range suitable for use with the circuit shown in the drawing is 10 volts DC to 276 volts AC, 50 or 60 Hz. The resulting input voltage to the autoranging power management circuit is 10 volts to 391 volts DC. The FET transistor Q8 is a high voltage switch and can be driven directly from the timer 11 while the autoranging power management circuit prevents the coil current from increasing as a result of an increase in the voltage applied to the power input terminals 2. The resistor R15 provides the gate drive for the transistor Q8 which is arranged to be a regulated value that does not change with input voltage. The diode CR7 and the resistor R14 provide a path to rapidly discharge the gate to source capacitance of the transistor Q8 for better "turn off" switching control. The switching rate determined by the timer 11 will be varied from "high" to "low" power by the frequency of the pulses from the timer 11.

The pulse supply circuit 10 limits the "low" power current since the output current limiter only limits the peak "high" power current. This is accomplished by controlling the high power "on" time. The autoranging power management circuit can maintain the "low" and "high" power constant for any given solenoid coil and input voltages by selecting the values for the $R_A$ and $R_B$ circuits formed by transistor Q4 and resistor $R_{19}$ and transistor Q6, respectively, e.g., a 6 volt solenoid coil can be operated up to 30 volts DC by simply selecting the resistors RA and RB to keep the power constant for each input voltage. The low power control is performed by resistor R19 and the transistor Q4 to permit the high voltage volt adjustment voltage circuit to select the proper "low" power state depending on the voltage input. Thus, the higher the input voltage the lower the frequency of the pulses from the timer 11 and the lower the power effectively supplied to the solenoid coil 6 which by proper selection of the frequency can keep the "low" power constant even when the input voltage is increased to 350 volts DC.

The operation of the transistor Q6 provides the high voltage adjustment to determine the length of time that the solenoid coil 6 will be energized at the "high" power level. The higher the input voltage, the less time that the valve solenoid coil will be in the "high" power mode. As the high voltage adjustment increases, the transistor Q3 will be turned on to provide more current to charge the capacitor C5 at a faster rate to limit the time in the "high" power mode. By reducing the energization time in the "high" power mode, the circuit can maintain constant power to the solenoid coil 6 over the voltage range of 10 to 350 volts DC.

The high voltage adjust voltage is determined by the voltage adjust circuit including the resistor R5, R6, R7, R8, R9 and the diodes CR4, CR5 and CR6. The voltage $V_{cc}$ is set for 8 volts and the non-linear transfer characteristic of the high voltage adjust circuit at the low voltage end is used to ensure operation at the 10 volt DC input voltage. The divider ratio with a 300 volt DC input voltage is 47 to 1, while at 50 volts the ratio is 22 to 1. The transistors Q2 and Q7 are used as emitter followers to prevent loading of the voltage dividers R6, R7, R8, R9. As the voltage input to the high voltage adjust circuit increases, the divider current increases and as the voltage drop across resistors R6, R7 and R8 increases they will ultimately reach the voltage necessary to forward bias the diodes CR4, CR5 and CR6, which will produce a constant 0.4 volt drop regardless of the further increase in current. The switching of the resistors occurs with the resistor R6 switching at the lowest current followed by resistor R7 and finally, by resistor R8. When all three sections switch, there is a 1.2 voltage drop plus a 0.4 voltage drop across CR3 resulting in a 1.6 voltage total drop and the current multiplied by the resistor R9 when added to the 1.6 volts will be the voltage presented to the base electrode of transistor Q2. The output voltage across resistor R10 will be 0.6 volts less than the divider voltage. The transfer characteristic can be modified if required by adding or subtracting sections and reselecting the values for resistors R6, R7 and R8.

Transistor Q3 is an inverting amplifier required to control the "low" power state with transistor Q7 functioning as an emitter follower to prevent loading of the inverting amplifier. The collector load for transistor Q3 includes resistors R28, R12 and R13 and diodes CR12 and CR13. This circuit functions as a variable gain amplifier which matches the overall transfer characteristics of the autoranging circuit to keep the "low" power state constant independent of the voltage applied. Thus, as the input voltage increases and the timer "on" time is contant, the "off" time determines the average power supplied to the solenoid coil 6. The variable gain amplifier transistor Q3 provides the "high" voltage adjust voltage necessary to keep the average "low" power constant.

The voltage required for the pulse supply is kept low and regulated, i.e., it does not follow the high input voltage. The voltage limit on the timer 11 is 17 volts DC whereas the circuit output driver can go up to 500 volts DC. Because of the higher voltage required as an input to the regulator, a control is provided by the regulator circuit 12 including the transistor Q1. The regulator provides to output voltages to ensure proper operation while the total current drain for the autorange control is approximately 0.6 milliamps. The transistor Q1 must be capable of handling the 400 volts DC but does not need to handle large currents.

Thus, the power management control circuit includes an input voltage conditioner, an output driver, a pulse supply, a regulator, an automatically controlled "high" and "low" power supply and a high voltage adjust voltage control. The autoranging control provides the means for operating a valve with one coil for different input voltages. This enables one coil to be used independently of the operating or input voltage which reduces manufacturing costs and provides product distribution benefits by reducing the number of different valve coils.

The following is a detailed list of the circuit components used in a preferred construction of the illustrated example of the present invention as shown in the single FIGURE drawing:

| | |
|---|---|
| | Timer |
| Timer 11 | Motorola T6G555 |
| | Diodes |
| CR1 | IN4007 |
| CR2, 3, 4, 5, 6 7, 8, 9, 10, 11 12, 13 | IN914 |
| | Zener Diodes |
| VR1 | IN4105 |
| VR2 | IN4102 |
| | Transistors |
| Q1 | MPSA44 |
| Q2, 3, 4, 5, 6, 7 | 2N3904 |
| Q8 | MFT |
| | Capacitors |
| C1 | 100 pf |
| C2, 3, 6 | .47 μf |
| C4 | 22 μf |
| C5 | .1 μf |

Resistors

| | | | | | |
|---|---|---|---|---|---|
| R1 | 3.9K | R9, R21 | 47K | R24, R15 | 10K |
| R2, R4 | 270K | R10 | 680K | R17 | 68K |
| R25, R3, R18 | 330K | R11 | 10 M | R19 | 6.8K |
| R5 | 2.2 M | R28, R12 | 33K | R20 | 4.7 M |
| R6 | 470K | R13 | 15K | R27 ,R23 | 1.5 M |
| R22, R7, R16 | 100K | R14 | 4.7K | R26 | 150K |
| R8 | 22K | | | | |

Accordingly, it may be seen, that there has been provided, in accordance with the present invention, an autoranging power management method and circuit for a solenoid actuator.

The embodiments of the present invention in which an exclusive property or privilege is claimed are defined as follows:

1. A power control circuit comprising
timer means for selectively providing a sequence of DC current pulses at a frequency dependent on a control signal applied thereto,
circuit means for applying the pulses to a DC operated electromagnetic solenoid,
power supply means responsive to an input voltage for supplying DC power to said timer means and
compensating means for controlling said timer means by the control signal to reduce the frequency of the pulses applied to the solenoid after an initial first frequency during a first time period for producing a first number of pulse applications during the first time period by changing the off time between the pulses to produce the reduced frequency and a consequent reduced number of pulses during a second time period following the first period in direct proportion to the magnitude of the input voltage to maintain a predetermined average current in said solenoid during the second time period of the reduced number of pulses.

2. A control circuit as set forth in claim 1 wherein said compensating means includes means responsive to the input voltage for changing the duration of said first time period in direct proportion to the magnitude of the input voltage to maintain a predetermined average current in said solenoid during the first time period.

3. A control circuit as set forth in claim 1 wherein said timer means includes a free-running oscillator means.

4. A control circuit as set forth in claim 1 wherein the pulse sequence has a maximum frequency of 2 kHz.

5. A control circuit as set forth in claim 1 wherein said timer means includes an oscillator means and said compensating means includes means for interrupting the operation of said oscillator means to eliminate output pulses from said oscillator means to maintain the average solenoid curent during the time of the reduced number of pulses.

6. A control circuit as set forth in claim 1 wherein said timer means includes input means for selectively initiating the sequence of control pulses.

7. A DC power control circuit for a DC operated solenoid valve comprising
a DC solenoid for operating a valve,
timer means for selectively providing a sequence of DC current pulses at a frequency dependent on a control signal applied thereto,
circuit means for applying the pulses to said DC solenoid coil,
power supply means responsive to an input voltage for supplying DC power to said timer means and
compensating means for controlling said timer means by the control signal to reduce the frequency of the pulses applied to the solenoid after an initial first frequency during a first time period for producing a first number of pulse applications during the first time period by changing the off time between the pulses to produce the reduced frequency and a consequent reduced number of pulses during a second time period following the first period in direct proportion to the magnitude of the input voltage to maintain a predetermined average current in said solenoid during the second time period of the reduced number of pulses.

8. A control circuit as set forth in claim 7 wherein said compensating means includes means responsive to the input voltage for changing the duration of said first time period in direct proportion to the magnitude of the input voltage to maintain a predetermined average current in said solenoid during the first time period.

9. A control circuit as set forth in claim 7 wherein said timer means includes a free-running oscillator means.

10. A control circuit as set forth in claim 7 wherein the pulse sequence has a maximum frequency of 2 kHz.

11. A control circuit as set forth in claim 7 wherein wherein said timer means includes an oscillator means and said compensating means includes means for interrupting the operation of said oscillator means to eliminate output pulses from said oscillator means to maintain the average solenoid current during the time of the reduced number of pulses.

12. A control circuit as set forth in claim 7 wherein said said timer means includes input means for selectively initiating the sequence of control pulses.

13. A control circuit as set forth in claim 8 wherein said timer means includes an oscillator means and said compensating means includes means for interrupting the operation of said oscillator means to eliminate output pulses from said oscillator means to maintain the average solenoid current during the time of the reduced number of pulses.

14. A method for supplying DC power from a source of DC power to an electromagnetic solenoid actuator including the steps of initially supplying DC current pulses of a fixed width at a first frequency from the source of DC power to the actuator and after a first time interval reducing the frequency of said fixed width pulses applied to the solenoid in direct proportion to an output voltage of the source of DC power.

15. A method as set forth in claim 14 and including the further step of changing the duration of the first time interval in direct proportion to the output voltage of the source of the DC power.

16. A method for supplying DC power to a solenoid of a DC solenoid operated valve including the steps of initially supplying DC current pulses of a fixed width at a first frequency to the actuator and after a first time interval reducing the frequency of said fixed width pulses applied to the solenoid in direct proportion to an output voltage of a source of the DC power.

17. A method as set forth in claim 16 and including the further step of changing the duration of the first time interval in direct proportion to the output voltage of the source of the DC power.

* * * * *